US009227744B2

(12) United States Patent
Giro Amigo

(10) Patent No.: US 9,227,744 B2
(45) Date of Patent: Jan. 5, 2016

(54) METHOD, SYSTEM AND MACHINE FOR PRODUCING AND FILLING BAGS

(75) Inventor: Ezequiel Giro Amigo, Badalona (ES)

(73) Assignee: Girnet International, S.L., Badalona (ES)

( * ) Notice: Subject to any disclaimer, the term of this patent is extended or adjusted under 35 U.S.C. 154(b) by 983 days.

(21) Appl. No.: 13/266,385

(22) PCT Filed: Mar. 25, 2010

(86) PCT No.: PCT/ES2010/070178

§ 371 (c)(1),
(2), (4) Date: Oct. 26, 2011

(87) PCT Pub. No.: WO2010/128185

PCT Pub. Date: Nov. 11, 2010

(65) Prior Publication Data

US 2012/0055121 A1 Mar. 8, 2012

(30) Foreign Application Priority Data

May 7, 2009 (ES) ..... 200901158

(51) Int. Cl.
*B65B 9/10* (2006.01)
*B65B 9/15* (2006.01)
*B65B 25/04* (2006.01)

(52) U.S. Cl.
CPC ..... *B65B 9/15* (2013.01); *B65B 25/048* (2013.01)

(58) Field of Classification Search
CPC ..... B65B 9/13; B65B 9/15; B65B 9/18; B65B 25/048
USPC ..... 53/551, 552, 554, 452, 567, 576
See application file for complete search history.

(56) References Cited

U.S. PATENT DOCUMENTS

| | | | | | |
|---|---|---|---|---|---|
| 3,924,522 | A | * | 12/1975 | Martin | 493/287 |
| 3,996,721 | A | * | 12/1976 | Mercer | 53/449 |
| 4,091,595 | A | * | 5/1978 | Pelster et al. | 53/417 |
| 4,790,124 | A | * | 12/1988 | Kaji | 53/552 |
| 5,729,961 | A | * | 3/1998 | Dauder-Guardiola | 53/459 |
| 7,222,469 | B2 | * | 5/2007 | Griggs et al. | 53/138.4 |
| 7,356,979 | B2 | | 4/2008 | Pannekeet | |
| 2004/0103621 | A1 | | 6/2004 | Pannekeet | |
| 2005/0235608 | A1 | | 10/2005 | Griggs et al. | |

FOREIGN PATENT DOCUMENTS

| | | | |
|---|---|---|---|
| DE | 29 19 567 | A1 | 11/1979 |
| EP | 302460 | A1 * | 2/1989 |

(Continued)

OTHER PUBLICATIONS

Spanish Search Report for Application No. ES20090001158 dated Nov. 7, 2011.

*Primary Examiner* — Andrew M Tecco
(74) *Attorney, Agent, or Firm* — Sughrue Mion, PLLC

(57) ABSTRACT

The invention relates to a method for producing and filling bags of produce using a supply of very long tubular netting. The invention includes: a loading phase, in which a segment of tubular net is positioned on a loading tube, such that the long end portion of the tubular net that encircles the tube is gathered, pleated and compressed longitudinally and such that a second short intermediate portion of the tubular net is stretched out, without gathering, and in which a loading hole is made in the stretched intermediate portion of the tubular net; and a production and filling phase, in which successive segments of the long gathered end portion of the tubular net are repeatedly stretched so that these segments ca be manipulated to form individual bags, the produce to be stored being inserted into each bag through the loading hole made in the stretched short intermediate portion of the tubular net.

19 Claims, 4 Drawing Sheets

(56) References Cited

FOREIGN PATENT DOCUMENTS

| | | | |
|---|---|---|---|
| EP | 0 315 882 | A1 | 5/1989 |
| EP | 1 053 939 | A1 | 11/2000 |
| EP | 1 529 003 | A2 | 5/2005 |
| ES | 2 182 664 | A1 | 3/2003 |
| FR | 2425983 | A1 * | 11/1979 |
| FR | 2 425 983 | A1 | 12/1979 |
| WO | WO 2004/009446 | A2 | 1/2004 |

* cited by examiner

METHOD, SYSTEM AND MACHINE FOR PRODUCING AND FILLING BAGS

CROSS REFERENCE TO RELATED APPLICATIONS

This application is a National Stage of International Application No. PCT/ES2010/070178, filed on Mar. 25, 2010, which claims priority from Spanish Patent Application No. P 200901158, filed on May 7, 2009, the contents of all of which are incorporated herein by reference in their entirety.

TECHNICAL FIELD OF THE INVENTION

The invention relates to a process, a system and a machine for manufacturing and filling bags with products, such as fruit and vegetable products, from a storage of tubular net with great length, for example in the form of a reel or sack.

BACKGROUND OF THE INVENTION

Different versions of machines for the manufacture and filling of mesh or net bags with fruit and vegetable products are known. These machines comprise a loading tube receiving the coupling of a tubular net loading unit, also called tube load, the mentioned tubular net being arranged around a gathered and longitudinally compacted loading tube, the length of which depends on the length of said loading tube and on the features of the mesh.

The tubular net is conventionally closed at its lower end, immediately below the lower mouth of the loading tube, to form the bottom of a bag which is then filled with the products which are introduced through the upper mouth of the tube and which fall by gravity inside it. The bag containing the products is finished and separated from the rest of the tubular net, the lower end of which is again closed to obtain another full bag, repeating the same operations again.

This type of machine must be periodically stopped so that the tube load is replaced, once out of tubular net, with another tube load that is loaded with a new tubular net.

The tube loads are coupled to the loading tube of the machine manually or by means of semiautomatic devices, but in any case the intervention of an operator is required.

For the purpose of maximally reducing these necessary stops which significantly affect the productivity of the machines and which require the supervision and intervention of an operator, machines have been disclosed that are provided with a loading tube and which similarly handle the tubular net during the manufacture and filling of the bags but in which, unlike the aforementioned machines, the tubular net is continuously developed, as the bags are manufactured, from a storage of mesh with great length in the form of a reel. The length of net conventionally wound in the form of a reel is much greater than the length of tubular net which can be gathered and longitudinally compacted in a tube load, being able to manufacture in the order of 2000 bags from the tubular net wound in a conventional reel, in comparison with approximately a hundred bags which can be manufactured from a standard tube load.

Patent documents EP 1053939 and EP 0315882 describe respective machines of this type comprising a vertical loading tube on which the tubular net which is drawn from a winding in the form of a reel is externally slid as the bags are manufactured. The machines are provided with drive means for the tubular net basically formed by inner rollers assembled in two of the opposite faces of the loading tube and corresponding outer support rollers, on which the mentioned inner rollers rest and between which the tubular net passes. The machines are furthermore provided with supplementary drive means for driving the tubular net, configured by way of an endless belt in the case of document EP 1053939 and rotating rollers in document EP 0315882, applied on the outer faces of the loading tube with the interposition of the tubular net.

In both machines, in the proximity of the lower mouth of the loading tube the latter is provided with a side opening through which the products to be packaged are introduced. To introduce said products in the bottom of the bag in the course of manufacture, a side opening is made in the portion of the tubular net covering the side opening of the loading tube, the operation being repeated every time a new section of tubular net is drawn from the reel, i.e., for each of the manufactured bags, when the side opening of the loading tube is covered again.

This slows down the speed of the machine while at the same time making it necessary to introduce an extra operation to close the side opening made in the tubular net after the introduction of the products in the bag in the course of manufacture precisely through said side opening.

As an alternative to these machines, patent document ES 2182664 describes a machine similar to the aforementioned ones but in which a continuous longitudinal cut is made along the entire tubular net as the latter slides on the loading tube. The cut made causes an opening in the net, suitable for introducing the products through said opening and through a side opening provided for such purpose in the loading tube, but it inevitably forces closing the tubular net again after introducing the products inside the loading tube before the tubular net slides below the level of the mouth of said loading tube. This operation has been proven to be very complicated technically, while at the same time it continues to involve a reduction in the operating speed of the machine. Furthermore, the bag finally obtained has a longitudinal seam along the entire length of the bag, which deteriorates its finish or makes the incorporation of a strip of flexible material to the bag necessary to cover said seam.

Therefore, an objective of the present invention is to disclose a process, a system and a machine that allow the continuous manufacture of bags from a storage of tubular net with great length, such as that of a storage in the form of a winding or reel, which solves the drawbacks of the known processes and of the known machines for putting them into practice.

DISCLOSURE OF THE INVENTION

The proposed process for manufacturing bags and filling them with products solves the aforementioned drawbacks. The process is characterized in that it comprises

- a loading phase, comprising the operations of arranging a section of tubular net drawn from a storage of tubular net with great length on a loading tube, having its ends at a different height, until said loading tube is longitudinally introduced inside the section of tubular net and such that a long end portion of the tubular net which tightly encircles the loading tube is gathered and compacted in the longitudinal direction and that a second short intermediate portion of the tubular net which tightly encircles the loading tube is drawn without being gathered; and of making a loading opening, by means of cutting, in the drawn short intermediate portion of the tubular net; and
- a manufacturing and filling phase, comprising the repeated operation of drawing successive sections of the gathered long end portion of the tubular net for the handling thereof in the manufacture of respective bags, introducing the products to be stored in each bag through the same loading opening made in the drawn short intermediate portion of the tubular net, the products falling by gravity through the loading tube until reaching the section of tubular net of the bag in the course of manufacture and being deposited therein.

According to the present process, a number of bags similar to that which can be obtained from a tube load is obtained from the long end portion of tubular net accumulated on the loading tube, gathered and compacted in the longitudinal direction. Advantageously, it is not necessary to make an opening for each of the bags obtained for the introduction of the products in the loading tube, since the opening is made in an intermediate portion of the tubular net, upstream from the accumulated net.

Once the accumulated net is consumed, the loading phase is repeated by drawing more tubular net from the storage of tubular net, placing it on the loading tube according to claim 1, to subsequently start again manufacturing and filling phase the without it having been necessary to replace any tube load.

According to another feature of the invention, once the net of the gathered long end portion of the tubular net is consumed, and prior to starting a new loading phase, the process comprises the operation of sliding the short intermediate portion of the tubular net outside the loading tube to a level below its lower mouth.

This short intermediate portion, in which a single loading opening has been made for the manufacture of the bags obtained from the accumulated net, is preferably discarded.

According to another feature of the invention, the length of the long end portion of the tubular net which is gathered and compacted in the longitudinal direction upon completing the loading phase is greater than 1 m.

Preferably, the length of said long end portion of the tubular net is comprised between 60 and 200 meters.

The system for manufacturing bags and filling them with products according to the invention comprises a storage of tubular net with great length and a machine for the manufacture and filling of packages provided with a loading tube having its ends at a different height, provided with a side opening and on which there is arranged a section of tubular net attached without interruption with the tubular net accumulated in the storage of tubular net, such that the net of a long end portion of said section of tubular net is gathered and compacted in the longitudinal direction, tightly encircling a lower portion of the loading tube and that the net of a short intermediate portion of one and the same tubular net, provided with a loading opening, is drawn tightly encircling an upper portion of the loading tube and such that the mentioned loading opening communicates with the inside of the loading tube through the side opening of the latter, the machine being provided with cutting means for making a loading opening in the short intermediate portion of the tubular net, with means for drawing successive sections of the long end portion of the tubular net accumulated in the lower portion of the loading tube and with means for handling the drawn sections of tubular net to make several bags without the short intermediate portion of the tubular net being moved from its position.

According to another feature of the system according to the invention, the length of the long end portion of the tubular net which is gathered and compacted in the longitudinal direction tightly encircling the lower portion of the loading tube is greater than 1 m, being preferably comprised between 60 and 200 meters.

According to another feature of the invention, the tubular net of the storage with great length has a length comprised between 100 and 1,500 m.

A machine for putting the process according to the invention into practice comprises a loading tube intended for being longitudinally introduced in the tubular net and a support structure for drive means for driving the tubular net outside the loading tube and for cutting means for cutting the mentioned tubular net.

The machine is essentially characterized in that the loading tube is provided with a side opening and with at least one transverse support roller, rotating about a shaft integral with the loading tube; and in that the drive means comprise at least two transverse and parallel rollers, applied on opposite faces of the loading tube, with the interposition of the tubular net during the operation of the machine, between which the loading tube is guided and on one of which its transverse support roller rests, the loading tube suspended from the support structure being prevented from moving in the downward direction, the loading tube being provided below the side opening with a lower portion with enough length so that a long end portion of the tubular net, gathered and compacted in the longitudinal direction, can tightly encircle it enough net for the manufacture of more than one bag being accumulated thereon.

According to another feature of the machine, the length of said lower portion of the loading tube below the side opening is comprised between 50 and 150 cm.

According to an embodiment, the drive means for driving the tubular net comprise at least two pairs of transverse and parallel rollers, between which the loading tube is arranged, guided and in the inclined position, and the rotating shaft of at least one of the rollers of each pair of transverse rollers is provided at its ends with respective coaxial limiting parts, integral with the rotating shaft of the roller, having an external surface divergent in the direction towards the end of the rotating shaft, suitable for limiting the transverse movement of the loading tube.

Preferably, the driving means for driving the tubular net furthermore comprise two side guiding bars, juxtaposed to the edges of respective coaxial limiting parts of one and the same roller and perpendicular to the rotation shaft of said roller, which are driven in a rotating movement about their actual shaft by said contiguous coaxial limiting parts and between which there are tightly arranged the loading tube and the tubular net tightly encircling it, during the operation of the machine.

According to another feature of the machine, the loading tube is provided with a polygonal cross section, determining in the tube at least two pairs of flat faces and opposite two by two, intended to receive the flat support of the corresponding transverse rollers of the drive means and, where appropriate, of the side guiding bars.

BRIEF DESCRIPTION OF THE DRAWINGS

The attached drawings illustrate, by way of non-limiting example, a sequence of the process according to the invention and some components of a machine for putting it into practice. Specifically.

DETAILED DESCRIPTION OF THE DRAWINGS

Figure 1:
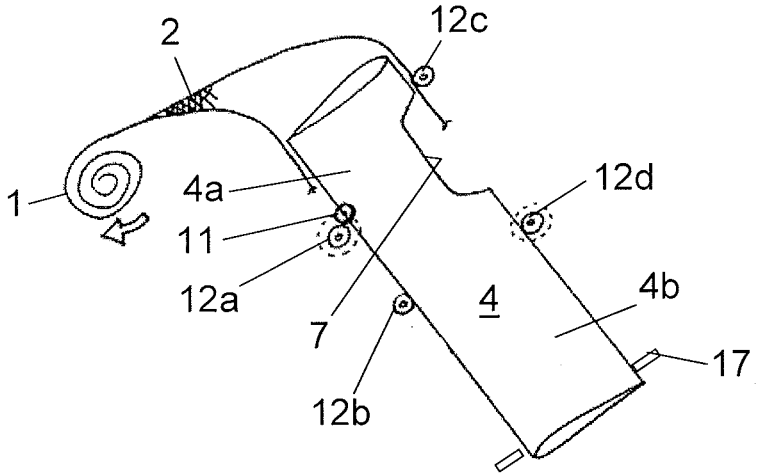
FIGS. 1 to 6 schematically show a sequence of the process according to the invention.
Figure 2:
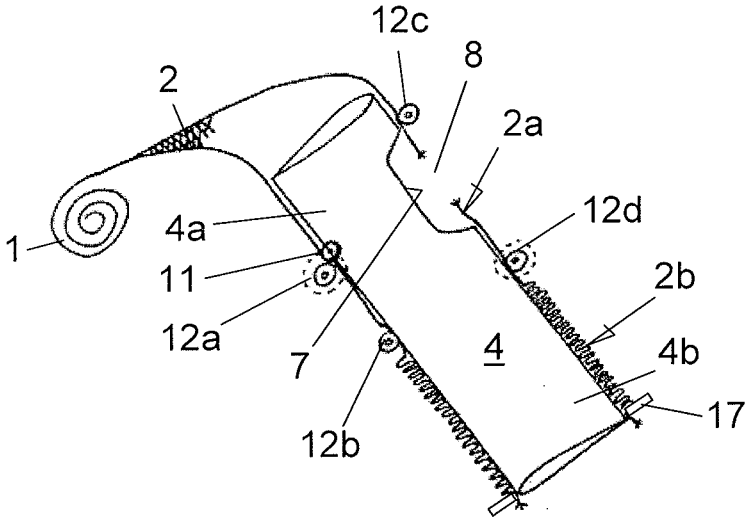
Figure 3:
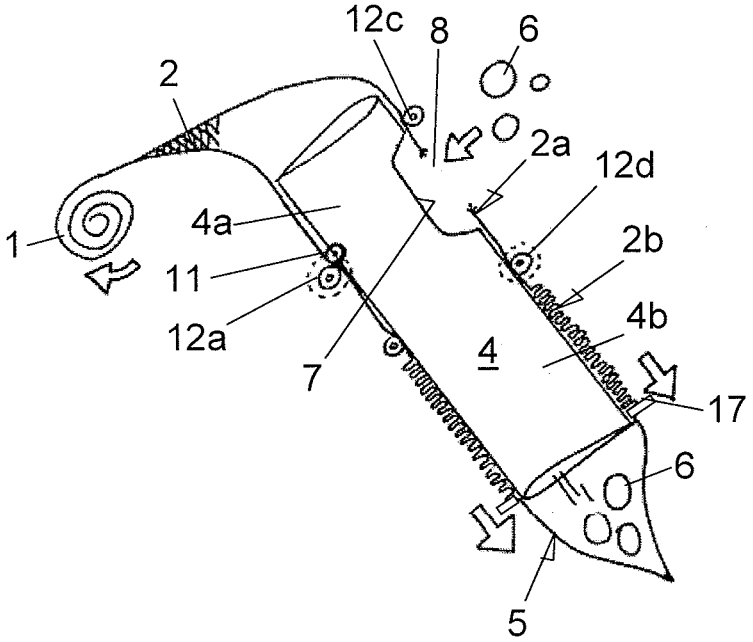
Figure 4:
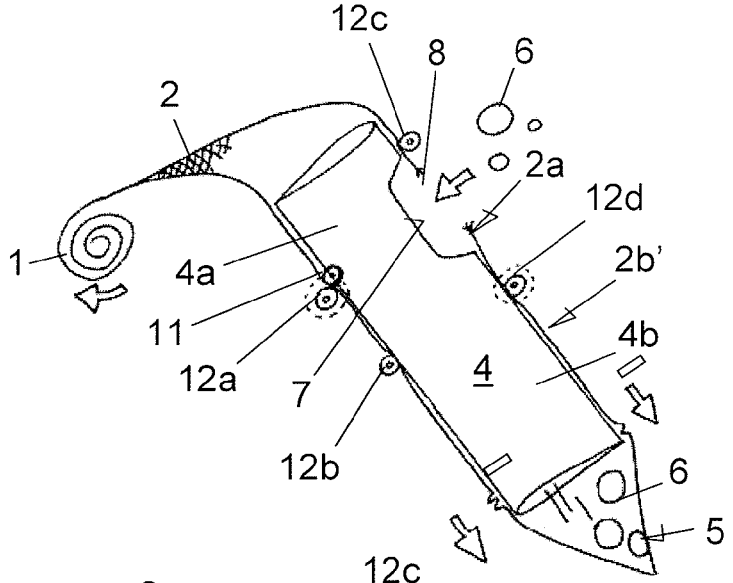

The process according to the invention comprises a loading phase, the operations of which have been schematically depicted in FIGS. 1 and 2, and a manufacturing and filling phase, also schematically depicted in the sequence of FIGS. 3 and 4.

Starting from the situation depicted in FIG. 1, the loading phase comprises the operation of drawing a section of tubular net 2 of a storage 1 of tubular net with great length, depicted in the form of a reel in said FIG. 1, and arranging the mentioned section of tubular net 2 on the loading tube 4 of a machine for the manufacture and filling of bags, provided with a side opening 7 in the upper portion 4*a* thereof.

As illustrated in FIG. 2, the section of net is placed on the loading tube 4 such that a long end portion 2*b* of the tubular net 2 which tightly encircles the lower portion 4*b* of the loading tube 4 is gathered and compacted in the longitudinal direction, and such that a short intermediate portion 2*a* of the tubular net 2 which tightly encircles the upper portion 4*a* of the loading tube 4 is drawn, without being gathered. The loading tube 4 is provided at its lower end, in a manner known per se, with braking means 17 which retain the tubular net 2 accumulated on the lower portion 4*b* of said loading tube 4.

Subsequently, the loading phase comprises the added operation of making a loading opening 8, by means of cutting, in the short intermediate portion 2*a* of the tubular net, covering a side opening 7 of the loading tube.

Then, the phase for manufacturing and filling the bags is started without the short intermediate portion 2*a* of the tubular net 2 moving, i.e., without the latter sliding outside the loading tube 4, which phase comprises the repeated operation of drawing successive sections 5 of the long end portion 2*b* of the tubular net 2 accumulated on the lower portion 4*b* of the loading tube 4, for the handling thereof in the manufacture of respective bags, introducing the products 6 to be stored in each bag through the same loading opening 8 made in the drawn short intermediate portion 2*a* of the tubular net 2, through the side opening 7 of the loading tube 4, the products 6 falling by gravity through the inside of said loading tube 4 until reaching the section of tubular net 2 of the bag in the course of manufacture and being deposited therein, all as illustrated by FIG. 3. Upon performing the operation of drawing the successive portions of tubular net 2 for the manufacture of the bags, the braking means 17 prevent drawing from the accumulated tubular net 2 more net than what is necessary.

The operations which are carried out on the drawn tubular mesh 2 of the long intermediate portion 2*b* for the manufacture of a respective bag are not described herein in detail as they are known and are not part of the invention. Generally, the tubular net 2 is closed below the mouth of the loading tube 4 by means of heat welding, there being formed an attachment area which is subsequently transversely cut at its mid point, the bottom of a bag to be manufactured and the closure of the mouth of the bag in the course of formation, previously filled, being simultaneously obtained. The products 6 are then introduced in the bag to be manufactured through the loading tube 4, said products 6 falling by gravity until being deposited in the already formed bottom of the bag, and similar to the previous closure, the tubular net 2 is closed by means of heat welding, the cutting and drawing operations being repeated again.

Figure 5:
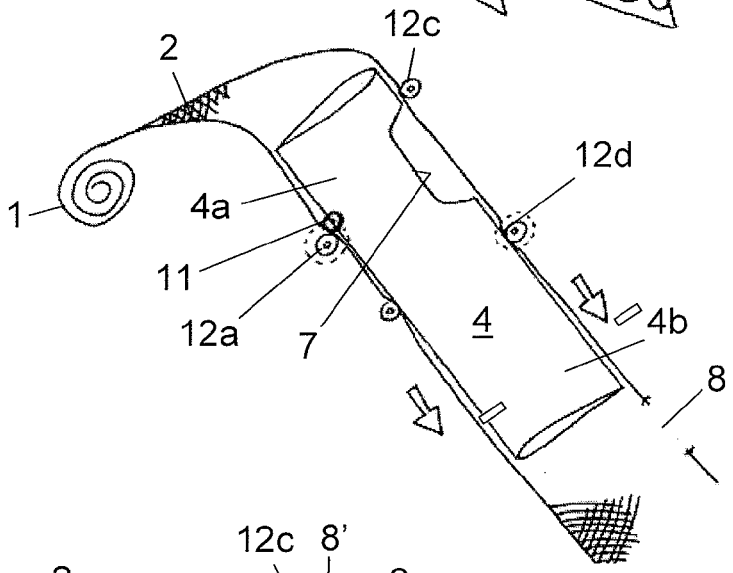
Figure 6:
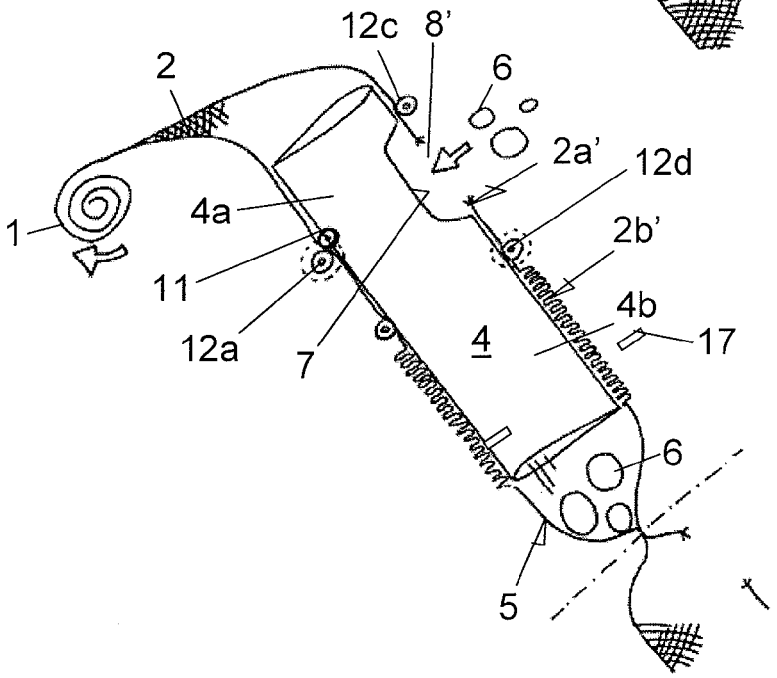

Once the net accumulated on the lower portion 4*b* of the loading tube 4 is consumed, i.e., the long end portion 2*b* of tubular net initially gathered and longitudinally compacted, situation illustrated in FIG. 4, the process comprises the operation of sliding the short intermediate portion 2*a* of the tubular net 2 outside the loading tube 4, to a level below its lower mouth (see FIG. 5) before starting a new loading phase and subsequent manufacturing and filling phase, as is shown in FIG. 6.

In this FIG. 6, the new long end portion of tubular net 2 has been designated with reference 2*b*', and the new short intermediate portion of said tubular net 2 has been designated with reference 2*a*'.

In the context of the invention, the words "long" and "short" are used to designate portions of tubular net 2 the lengths of which are very different from one another. Said terms are not used to designate portions of tubular net 2 the length of which in absolute values is considered large or small, respectively, but rather they are used to differentiate the end portion of net which tightly encircles the lower portion 4*b* of the loading tube 4 after the loading phase is completed, 100 m for example, from the short intermediate portion which tightly encircles the upper portion 4*a* of the loading tube 4, the length of which is approximately 1 m.

Regarding the storage 1 of tubular net 2 "with great length", in the context of the invention it relates to storages in the form of a conventional reel or sack, which store tubular net the length of which reaches 1,500 m, much more than the usual length of tubular net accumulated in a conventional tube load, in the order of 100 m.

Figure 7:
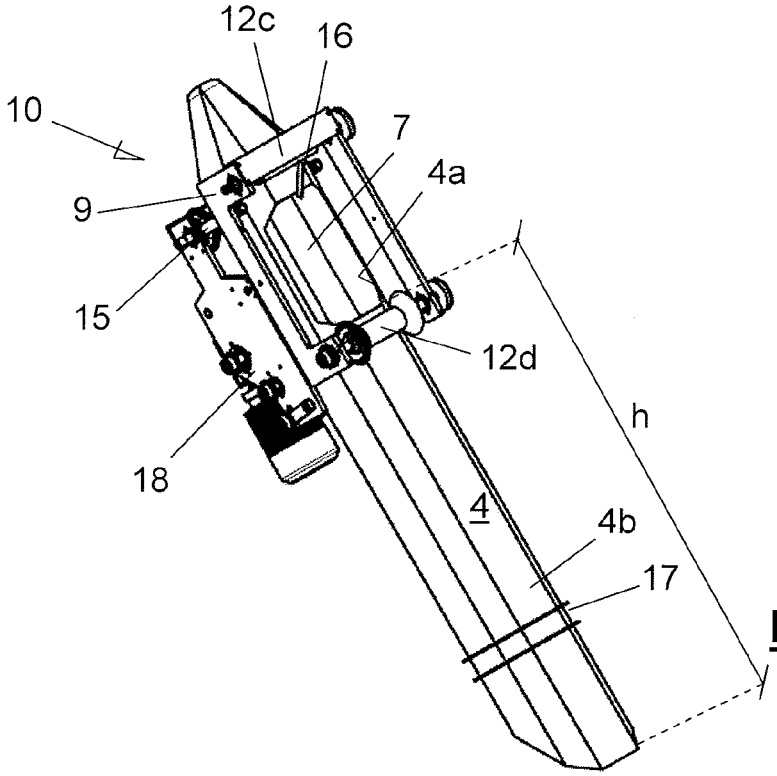
FIG. 7 is a perspective view of the loading tube and of the support structure for the drive and cutting means for driving and cutting the tubular net.

FIG. 7 shows part of a machine 10 for manufacturing bags and filling them with products, such as fruit and vegetable products, from a storage of tubular net with great length, not depicted. The machine 10 comprises a loading tube 4, intended to be longitudinally introduced in the tubular net, and a support structure 9 for drive means for driving the tubular net outside the loading tube and for cutting means 16 for cutting the mentioned tubular net, depicted in greater detail in FIG. 8.

The upper portion 4*a* of the loading tube 4 is provided with a side opening 7 and with a transverse support roller 11 (not visible in FIG. 7 but depicted in FIGS. 1 to 6 and 9) rotating about a shaft integral with the loading tube 4, whereas the lower portion 4*b* of the loading tube 4 is provided with braking means 17, of the known type, to prevent the tubular net 2 from sliding by gravity in the direction towards the mouth of the loading tube. The drive means comprise two pairs of transverse and parallel rollers, the rollers 12*a* and 12*b* of the lower pair applied on a first face of the loading tube 4, and the rollers and 12*c* and 12*d* of the upper pair on the opposite face of the loading tube 4, with the interposition of the tubular net during the operation of the machine 10. As has been depicted in FIGS. 1 to 6 and 9, the transverse support roller 11 of the loading tube 4 rests on the roller 12*a* of the lower pair, the loading tube 4 suspended from the support structure 9 thus being prevented from moving in the downward direction. It is seen in FIG. 7 that the lower portion 4*b* of the loading tube is suitable so that a long end portion of the tubular net, gathered and compacted in the longitudinal direction, can tightly encircle it, enough net for the manufacture of more than one bag being accumulated on said lower portion 4*b*. By way of example, the distance h indicated in FIG. 7 of the example machine is 113.5 cm.

Figure 8:
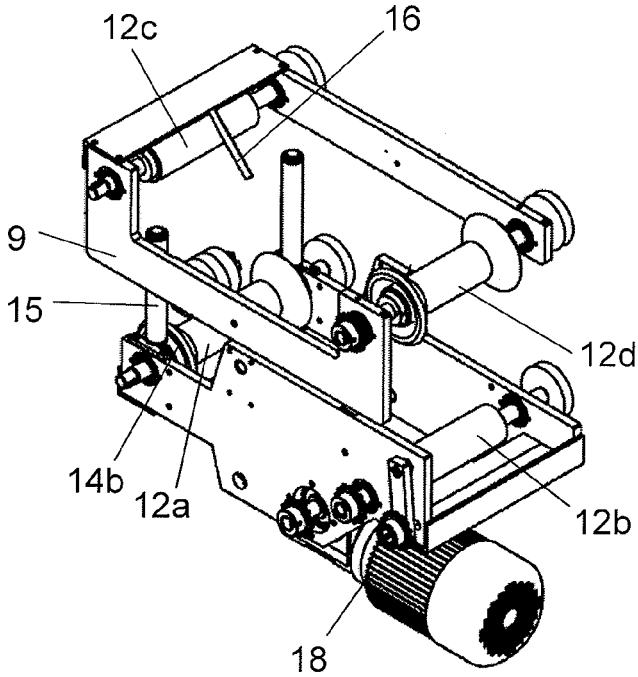
FIG. 8 is a view in greater detail of the mentioned drive and cutting means for driving and cutting the tubular net.

FIG. 8 shows the support structure 9, in which the pair of upper transverse rollers 12*c* and 12*d* are assembled, the rotating shafts of which rollers are supported by a first rigid frame, essentially formed by two flat parallel plates attached to one another by the rotating shafts of the transverse rollers and by at least one attachment bridge.

In turn, the pair of lower transverse rollers 12*a* and 12*b* are supported by a second rigid frame also formed by two flat parallel plates attached to one another by the rotating shafts of the mentioned lower transverse rollers and by at least one attachment bridge.

Although it is not depicted, the first and second frames can be attached to one another by threaded rigid rods, which allow graduating the distance between both frames.

Arranged on the attachment bridge between the plates of the first frame are the cutting means 16, comprising a device for actuating a blade. The drive motor 18 of the rotating shafts of the transverse rollers is fixed in the lower frame, the rotating movement of its input shaft being transmitted to said rotating shafts by means of belts, chains or the like.

Figure 9:
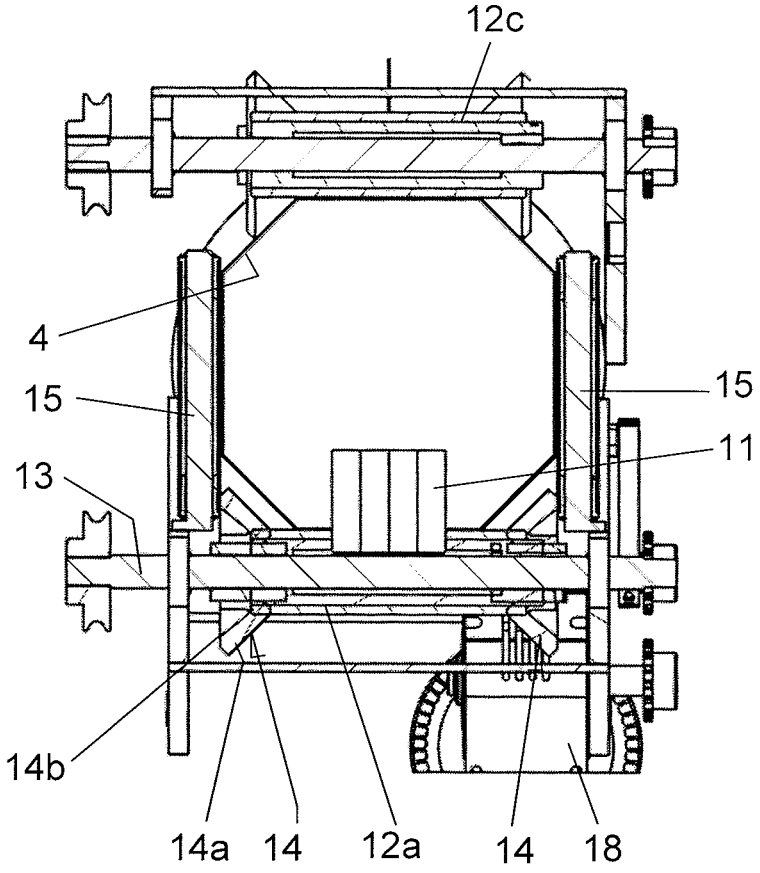
FIG. 9 is a cross section according to a section plane perpendicular to the longitudinal shaft of the loading tube of the machine depicted in FIG. 7.

FIG. 9 is a cross section according to a section plane perpendicular to the longitudinal shaft of the loading tube of the machine depicted in FIG. 7 at the level of the roller 12*a*.

It is observed in FIG. 9 that the rotating shaft 13 of the roller 12*a* is provided at its ends with respective coaxial limiting parts 14, integral with the rotating shaft 13, having an external surface 14*a* divergent in the direction towards the end of the mentioned rotating shaft 13, suitable for limiting the transverse movement of the loading tube 4.

In the same FIG. 9 it is observed that the drive means furthermore comprise two side guiding bars 15, juxtaposed to the edges 14*b* of the coaxial limiting parts 14 of the roller 12*a*, perpendicular to the rotating shaft 13 of said roller 12*a*, which are driven in a rotating movement about their longitudinal shaft by said contiguous coaxial limiting parts 14. The rotating movement of these guiding bars 15 follows the tubular mesh 2, favouring its sliding outside the loading tube 4.

The invention claimed is:

1. A process for manufacturing bags and filling them with products from a storage of tubular net with great length, comprising a loading phase, comprising the operations of arranging a section of tubular net on a loading tube, having its ends at a different height, until said loading tube is longitudinally introduced inside the mentioned section of tubular net and such that a long end portion of the tubular net which tightly encircles the loading tube is gathered and compacted in the longitudinal direction and that a second short intermediate portion of the tubular net which tightly encircles the loading tube remains drawn without being gathered; and of making a loading opening in the drawn short intermediate portion of the tubular net by means of cutting; and a manufacturing and filling phase, comprising the repeated operation of drawing successive sections of the gathered long end portion of the tubular net for the handling thereof in the manufacture of respective bags, introducing the products to be stored in each bag through the same loading opening made in the drawn short intermediate portion of the tubular net, the products falling by gravity through the loading tube until reaching the section of tubular net of the bag in the course of manufacture and being deposited therein, wherein once the net of the gathered long end portion of the tubular net is consumed, and prior to starting a new loading phase, the process comprises the operation of sliding the short intermediate portion of the tubular net outside the loading tube to a level below its lower mouth.

2. The process according to claim 1, wherein the length of the long end portion of the tubular net which is gathered and compacted in the longitudinal direction upon completing the loading phase is greater than 1 m.

3. The process according to claim 2, wherein the length of said long end portion of the tubular net is comprised between 60 and 200 meters.

4. A system for manufacturing bags and filling them with products comprising a storage of tubular net with great length and a machine for the manufacture and filling of packages provided with a drive means and a loading tube having its ends at a different height, which is provided with a side opening and on which there is arranged a section of tubular net attached without interruption with the tubular net accumulated in the storage of tubular net, such that the net of a long end portion of said section of tubular net is gathered and compacted in the longitudinal direction tightly encircling a lower portion of the loading tube and that the net of a short intermediate portion of the same tubular net, provided with a loading opening, remains drawn tightly encircling an upper portion of the loading tube and such that the mentioned loading opening communicates with the inside of the loading tube through the side opening thereof, the machine being provided with cutting means for making a loading opening in the short intermediate portion of the tubular net, manufacturing bags and filling them with products without the short intermediate portion of the tubular net being moved from its position, wherein the drive means makes the short intermediate portion of the tubular net slide outside the loading tube to a level below its lower mouth once the net of the gathered long end portion of the tubular net is consumed.

5. The system according to claim 4, wherein the length of the long end portion of the tubular net which is gathered and compacted in the longitudinal direction tightly encircling the lower portion of the loading tube is greater than 1 m.

6. The system according to claim 5, wherein the length of said long end portion of the tubular net is comprised between 60 and 200 m.

7. The system according to claim 4, wherein the length of the tubular net with great length of the storage is comprised between 100 and 1,500 m.

8. A machine for manufacturing bags and filling them with products from a storage of tubular net with great length, comprising a loading tube intended to be longitudinally introduced in the tubular net and a support structure for drive means for driving the tubular net outside the loading tube and for cutting means for cutting the mentioned tubular net, wherein the loading tube is provided with a side opening and with at least one transverse support roller, rotating about a shaft integral with the loading tube; and in that the drive means comprise at least two transverse and parallel rollers, applied on opposite faces of the loading tube, with the interposition of the tubular net during the operation of the machine, between which the loading tube is guided and on one of which its transverse support roller rests, the loading tube suspended from the support structure being prevented from moving in the downward direction, the loading tube being provided below the side opening with a lower portion with enough length so that a long end portion of the tubular net, gathered and compacted in the longitudinal direction, can tightly encircle it, enough net for the manufacture of more than one bag being accumulated on the lower portion, wherein the drive means makes a short intermediate portion of the tubular net slide outside the loading tube to a level below its lower mouth once the net of the gathered long end portion of the tubular net is consumed.

9. The machine according to claim 8, wherein the length of said lower portion of the loading tube below the side opening is comprised between 60 and 200 cm.

10. The machine according to claim 8, wherein the drive means for driving the tubular net comprise at least two pairs of parallel transverse rollers between which the loading tube is arranged, guided and in the inclined position, and in that a rotating shaft of at least one of the rollers of each pair of transverse rollers is provided at its ends with respective coaxial limiting parts, integral with the rotating shaft of the roller, having an external surface divergent in the direction towards the end of the rotating shaft, suitable for limiting the transverse movement of the loading tube.

11. The machine according to claim 10, wherein the drive means for driving the tubular net furthermore comprise two side guiding bars juxtaposed to the edges of respective coaxial limiting parts of one and the same roller and perpendicular to the rotating shaft of said roller, which are driven in a rotating movement about their shaft by said contiguous coaxial limiting parts and between which there are tightly arranged the loading tube and the tubular net tightly encircling it, during the operation of the machine.

12. The machine according to claim 8, wherein the loading tube is provided with a polygonal cross section, having at least two pairs of flat faces, configured to receive a flat support of the corresponding transverse rollers of the drive means and, where appropriate, of the side guiding bars.

13. The system according to claim 4, wherein the short intermediate portion of the tubular net that remains drawn tightly is not gathered.

14. The system according to claim 4, wherein the short intermediate portion of the tubular net that is not gathered is on a tubular net feeding end of the loading tube and the long end portion of the tubular net that is gathered is on an opposed lower output end of the loading tube.

15. The machine according to claim 8, wherein the short intermediate portion of the tubular net that remains drawn tightly is not gathered.

16. The machine according to claim 8, wherein the short intermediate portion of the tubular net that is not gathered is on a tubular net feeding end of the loading tube and the long end portion of the tubular net that is gathered is on an opposed lower output end of the loading tube.

17. The process according to claim 1, wherein the short intermediate portion of the tubular net that is not gathered is on a tubular net feeding end of the loading tube and the long end portion of the tubular net that is gathered is on an opposed lower output end of the loading tube.

18. A machine for manufacturing bags and filling the bags with products, the machine comprising:

a supply of tubular net;

a hollow loading tube that accommodates the tubular net around the loading tube;

a support structure on the outside of the loading tube, the support structure comprising a driving unit configured to drive the tubular net along the loading tube and a cutting unit configured to cut the tubular net, wherein the loading tube comprises a side loading opening on the outside of the loading tube near a first end and a second opening at a second end, wherein the tubular net has a first section, which is drawn straight, that is near the side loading opening and a second section between the first section and the second end of the loading tube that is gathered, such that the second section comprises a length of tubular net sufficient for a plurality of bags, wherein the cutting unit cuts an opening in the first section of the tubular net over the side loading opening such that a product can be loaded through the side loading opening and inside the loading tube into the tubular net, wherein a plurality of bags can be manufactured from the length of tubular net of the second section and loaded with the product through the opening in the first section of the tubular net, wherein the driving unit makes the first section of the tubular net slide outside the loading tube to a level below its lower mouth once the net of the gathered second section of the tubular net is consumed.

19. The machine according to claim 18, wherein the product is loaded inside the loading tube in a same direction as movement of the tubular net along the loading tube.

* * * * *